US009734800B2

(12) United States Patent
Han et al.

(10) Patent No.: US 9,734,800 B2
(45) Date of Patent: Aug. 15, 2017

(54) ORGANIC LIGHT EMITTING DISPLAY WITH SENSOR TRANSISTOR MEASURING THRESHOLD VOLTAGES OF DRIVING TRANSISTORS

(71) Applicant: LG Display Co., Ltd., Seoul (KR)

(72) Inventors: Sungman Han, Paju-si (KR); Jongsik Shim, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 61 days.

(21) Appl. No.: 14/788,392

(22) Filed: Jun. 30, 2015

(65) Prior Publication Data

US 2016/0012800 A1 Jan. 14, 2016

(30) Foreign Application Priority Data

Jul. 10, 2014 (KR) ..... 10-2014-0086922

(51) Int. Cl.
*G09G 3/30* (2006.01)
*G09G 5/18* (2006.01)
(Continued)

(52) U.S. Cl.
CPC ..... *G09G 5/18* (2013.01); *G09G 3/3208* (2013.01); *G09G 3/3233* (2013.01);
(Continued)

(58) Field of Classification Search
CPC ..... G09G 3/32; G09G 3/3208; G09G 3/3216; G09G 3/3225; G09G 3/3258; G09G 3/3266; G09G 3/3275
(Continued)

(56) References Cited

U.S. PATENT DOCUMENTS

2008/0231562 A1* 9/2008 Kwon ..... G09G 3/3233 345/77
2011/0012819 A1* 1/2011 Ryu ..... G09G 3/3233 345/82
(Continued)

FOREIGN PATENT DOCUMENTS

CN 102549646 A 7/2012
CN 103165078 A 6/2013
(Continued)

OTHER PUBLICATIONS

Chinese First Office Action, Chinese Application No. 201510404886.0, dated May 2, 2017, 11 pages.

*Primary Examiner* — Alexander Eisen
*Assistant Examiner* — Nelson Lam
(74) *Attorney, Agent, or Firm* — Fenwick & West LLP

(57) ABSTRACT

In one aspect, there is an organic light emitting display comprising: a display panel including subpixels; a data driver that supplies a data signal to the display panel; a scan driver that supplies a scan signal to the display panel; and a sensing circuit unit that measures the threshold voltages of driving transistors through sensor transistors of the display panel and prepares compensation data, wherein the scan driver turns on the sensor transistor of a selected subpixel to measure the threshold voltage of the driving transistor of the selected subpixel during a vertical blank interval of the display panel, and turns on the sensor transistors of non-selected subpixels to supply voltages below the threshold voltage of organic light emitting diodes to the non-selected subpixels during an image display interval of the display panel.

20 Claims, 9 Drawing Sheets

(51) Int. Cl.
*G09G 3/3208* (2016.01)
*G09G 3/3233* (2016.01)

(52) U.S. Cl.
CPC ..... *G09G 2300/0861* (2013.01); *G09G 2310/0251* (2013.01); *G09G 2320/0295* (2013.01); *G09G 2320/043* (2013.01)

(58) Field of Classification Search
USPC ..... 345/76–83; 315/169.3
See application file for complete search history.

(56) References Cited

U.S. PATENT DOCUMENTS

| | | | | |
|---|---|---|---|---|
| 2011/0043502 | A1* | 2/2011 | Yamashita | G09G 3/3233 345/207 |
| 2011/0063283 | A1* | 3/2011 | Ryu | G09G 3/3283 345/214 |
| 2011/0084955 | A1* | 4/2011 | Kim | G09G 3/3283 345/212 |
| 2012/0169799 | A1* | 7/2012 | Ono | G09G 3/3233 345/690 |
| 2013/0093652 | A1* | 4/2013 | Kim | G09G 3/3233 345/77 |
| 2013/0147690 | A1* | 6/2013 | Kim | G09G 3/3233 345/76 |
| 2013/0147694 | A1* | 6/2013 | Kim | G09G 3/32 345/82 |
| 2014/0062331 | A1* | 3/2014 | Nam | G09G 3/3233 315/226 |

FOREIGN PATENT DOCUMENTS

| | | | |
|---|---|---|---|
| CN | 103886830 | A | 6/2014 |
| EP | 2747066 | A1 | 6/2014 |

* cited by examiner

ORGANIC LIGHT EMITTING DISPLAY WITH SENSOR TRANSISTOR MEASURING THRESHOLD VOLTAGES OF DRIVING TRANSISTORS

This application claims the priority benefit of Korean Patent Application NO. 10-2014-0086922 filed on Jul. 10, 2014, which is incorporated herein by reference for all purposes as if fully set forth herein.

BACKGROUND

Field

This document relates to an organic light emitting display and a method of driving the same.

Related Art

With the development of information technology, the market for display devices (i.e., media connecting users and information) is growing. In line with this trend, the use of display devices, such as an organic light emitting display (OLED), a liquid crystal display (LCD), and a plasma display panel (PDP), is increasing.

Among the above-mentioned display devices, the organic light emitting display comprises a display panel comprising a plurality of subpixels and a drive unit that drives the display panel. The drive unit comprises a scan driver for supplying a scan signal (or gate signal) to the display panel and a data driver for supplying a data signal to the display panel.

When a scan signal, a data signal, etc. are supplied to the subpixels arranged in a matrix form, an organic light emitting display is able to display an image by allowing selected subpixels to emit light.

However, the characteristics (threshold voltage, current mobility, etc.) of the driving transistor of each subpixel change after a long period of use, thus bringing about various problems to the organic light emitting display, including reduced lifetime of the device caused by a decrease in operating current over time. Hence, a solution to these problems is needed.

SUMMARY

In one aspect, there is an organic light emitting display comprising: a display panel including subpixels; a data driver that supplies a data signal to the display panel; a scan driver that supplies a scan signal to the display panel; and a sensing circuit unit that measures the threshold voltages of driving transistors through sensor transistors of the display panel and prepares compensation data, wherein the scan driver turns on the sensor transistor of a selected subpixel to measure the threshold voltage of the driving transistor of the selected subpixel during a vertical blank interval of the display panel, and turns on the sensor transistors of non-selected subpixels to supply voltages below the threshold voltage of organic light emitting diodes to the non-selected subpixels during an image display interval of the display panel.

In another aspect, there is a method of driving an organic light emitting display, the method comprising: turning on the sensor transistor of a selected subpixel to measure the threshold voltage of the driving transistor of the selected subpixel during a vertical blank interval of a display panel; turning on the sensor transistors of non-selected subpixels to supply voltages below the threshold voltage of organic light emitting diodes to the non-selected subpixels during an image display interval of the display panel; and preparing compensation data based on the threshold voltage of the driving transistor and outputting the compensation data.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION

Reference will now be made in detail to embodiments of the invention, examples of which are illustrated in the accompanying drawings.

Hereinafter, an implementation of this document will be described with reference to the accompanying drawings.

Figure 1:
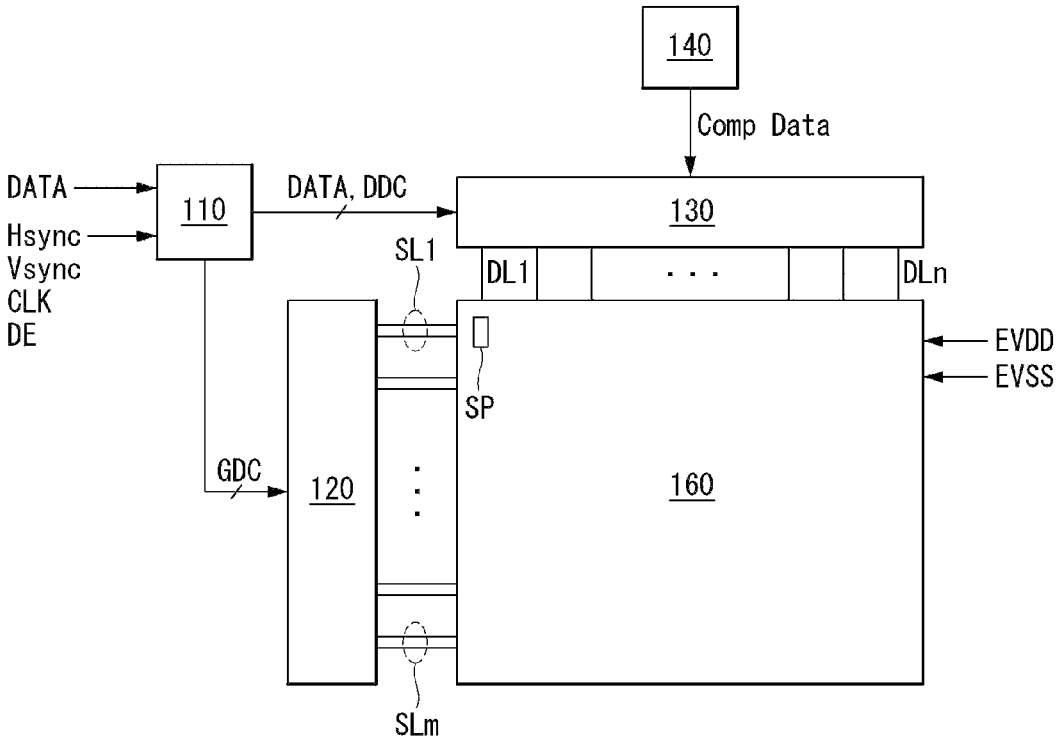
FIG. 1 is a view illustrating the configuration of an organic light emitting display according to an exemplary embodiment of the present invention.
Figure 2:
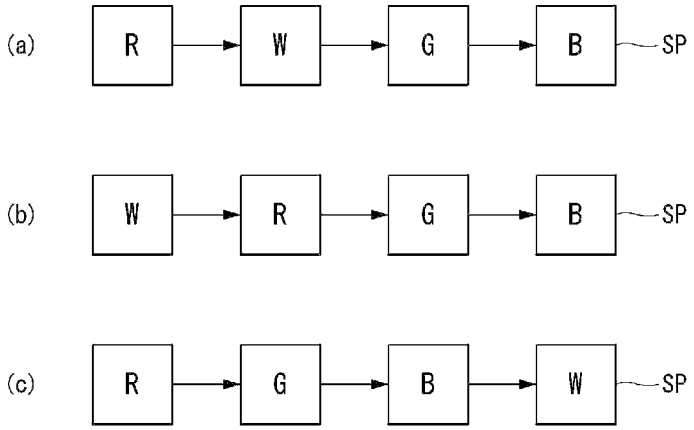
FIG. 2 is a view for explaining the order in which subpixels formed on a display panel are sensed according to the exemplary embodiment of the present invention.

FIG. 1 is a view illustrating the configuration of an organic light emitting display according to an exemplary embodiment of the present invention. FIG. 2 is a view for explaining the order in which subpixels formed on a display panel are sensed according to the exemplary embodiment of the present invention.

As shown in FIG. 1, the organic light emitting display according to the exemplary embodiment of the present invention comprises a timing controller 110, a scan driver 120, a data driver 130, a sensing circuit unit 140, and a display panel 160.

The timing controller 110 controls the operation timings of the scan driver 120 and data driver 130 by using externally-supplied timing signals such as a vertical synchronization signal Vsync, a horizontal synchronization signal Hsync, a data enable signal DE, and a clock signal CLK.

As the timing controller 110 is able to detect a frame period by counting data enable signals DE for 1 horizontal period, the externally-supplied vertical synchronization signal Vsync and horizontal synchronization signal Hsync may be omitted. Control signals generated by the timing controller 110 comprise a gate timing control signal GDC for controlling the operation timing of the scan driver 120 and a data timing control signal DDC for controlling the operation timing of the data driver 130.

The scan driver 120 sequentially generates scan signals while shifting the level of a gate driving voltage in response to a gate timing control signal GDC supplied from the timing controller 110.

The scan driver 120 supplies scan signals through scan lines SL1 to SLm connected to the subpixels SP included in the display panel 160. The scan driver 120 may be formed in the form of an integrated circuit (IC) and mounted on an external substrate, or may be formed in a bezel area of the display panel 160 in the form of a Gate-In-Panel using a thin film process.

The data driver 130 samples and latches a data signal DATA supplied from the timing controller 110 in response to a data timing control signal DDC supplied from the timing controller 110, and converts it into a data signal in parallel data format. The data driver 130 converts a digital data signal to analog format in response to a gamma reference voltage.

The data driver 130 supplies data signals DATA through data lines DL1 to DLm connected to the subpixels SP included in the display panel 160. The data driver 130 may be formed in the form of an integrated circuit (IC) and mounted on an external substrate, or may be mounted in a bezel area of the display panel 160.

The display panel 160 comprises subpixels SP arranged in a matrix. The subpixels SP emit light in response to a first potential voltage (high voltage) supplied from a first potential voltage line EVDD and a second potential voltage (low voltage) supplied from a second potential voltage line EVSS, as well as a scan signal supplied from the scan driver 120 and a data signal supplied form the data driver 130.

The subpixels SP of the display panel 160 may comprise red subpixels, green subpixels, and blue subpixels, or in some cases may comprise white subpixels. In the display panel 160 comprising white subpixels, the light emitting layer of each of the subpixels SP may emit white light, rather than green and blue lights. In this instance, the emitted white light is converted into red, green, and blue lights by RGB color filters. However, the white subpixels emit white light without the conversion.

The sensing circuit unit 140 measures the threshold voltage of the driving transistors of the subpixels of the display panel 160, and prepares compensation data Comp Data for compensating a data signal DATA. When measuring the threshold voltages of the driving transistors of the subpixels of the display panel 160 and preparing the compensation data Comp Data, the sensing circuit unit 140 supplies an initialization voltage (or reference voltage) through a reference line of the subpixels of the display panel 160 and senses the threshold voltages of the driving transistors through the sensor transistors of the subpixels.

The sensing circuit unit 140 may sense the threshold voltages of the driving transistors in various ways. In a first example, the sensing circuit unit 140 may sense the threshold voltages of the driving transistors of subpixels on a scan-line-by-scan-line basis on the display panel 160 (this is defined as line sensing). Line sensing refers to sensing the threshold voltages of the driving transistors of a line of subpixels.

In a second example, the sensing circuit unit 140 may divide scan lines on the display panel 160 into blocks and sense the threshold voltages of the driving transistors of the subpixels on a block-by-block basis (this is defined as block sensing). Block sensing refers to sensing the threshold voltages of the driving transistors of N blocks of subpixels (N is an integer equal to or greater than 2).

In a third example, the sensing circuit unit 140 may sense the threshold voltages of the driving transistors of the subpixels on a frame-by-frame basis on the display panel 160 (this is defined as frame sensing). Frame sensing refers to sensing the threshold voltages of the driving transistors of all the subpixels of the display panel 160.

In a fourth example, the sensing circuit unit 140 may randomly select one from among line sensing, block sensing, and frame sensing, according to various modes, conditions, or statuses of the display panel 160 and sense the threshold voltages of the driving transistors of subpixels (this is defined as random sensing).

As shown in FIGS. 1 and 2, the subpixels SP of the display panel 160 may comprise a red subpixel R, a green subpixel G, a blue subpixel B, and a white subpixel W which constitute a pixel. The sensing circuit unit 140 may perform line sensing on the subpixels SP of the display panel 160. A concrete example of line sensing will be described.

The sensing circuit unit 140 may obtain sensing values (Vth sensing data) corresponding to the threshold voltages of the driving transistors in the order of R, W, G, and B subpixels SP, as shown in (a) of FIG. 2, or obtain sensing values (Vth sensing data) corresponding to the threshold voltages of the driving transistors in the order of W, R, G, and B subpixels SP, as shown in (b) of FIG. 2, or obtain sensing values (Vth sensing data) corresponding to the threshold voltages of the driving transistors in the order of R, G, B, and W, as shown in (c) of FIG. 2.

However, the above-mentioned orders are only examples based on the assumption that the display panel 160 comprises four subpixels SP of RGBW, and the present invention is not limited to them. Accordingly, although not shown, provided that the display panel 160 comprises three subpixels SP of RGB, rather than four subpixels SP of RGBW, sensing values (Vth sensing data) corresponding to the threshold voltages of the driving transistors may be obtained in the order of R, G, and B.

However, the characteristics (threshold voltage, current mobility, etc.) of the driving transistor of each subpixel change after a long period of use, thus bringing about various problems to the organic light emitting display, including reduced lifetime of the device caused by a decrease in operating current over time. To solve this, the sensing circuit unit 140 is included in the organic light emitting display, which will be concretely described below.

Figure 3:
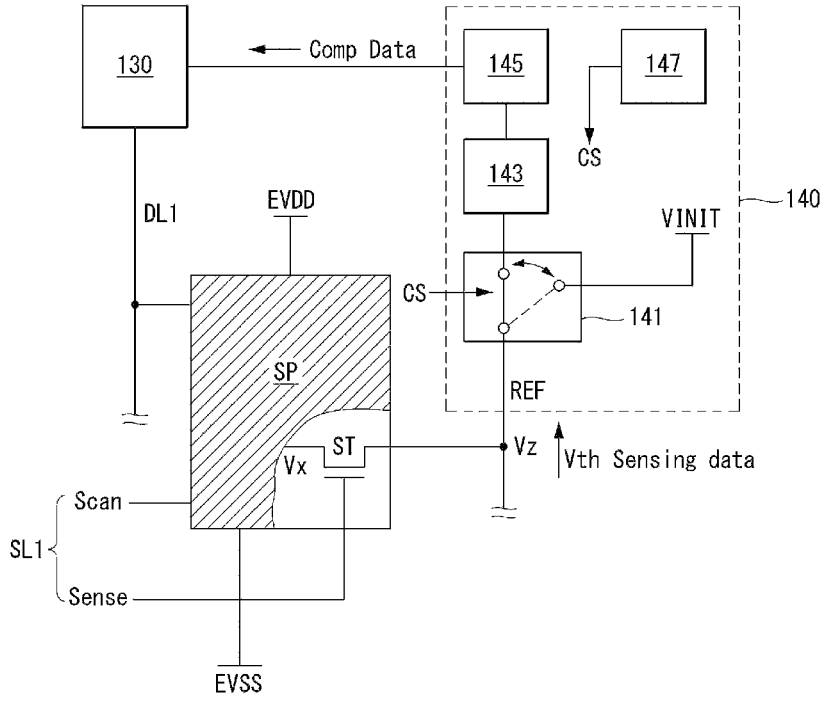
FIG. 3 is a view illustrating a detailed configuration of a part of the device according to the exemplary embodiment of the present invention.
Figure 4:
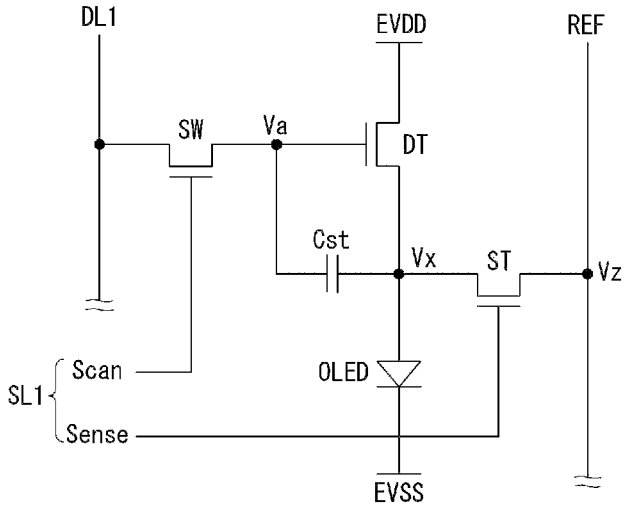
FIG. 4 is a view illustrating the circuit configuration of the subpixel of FIG. 3.
Figure 5:
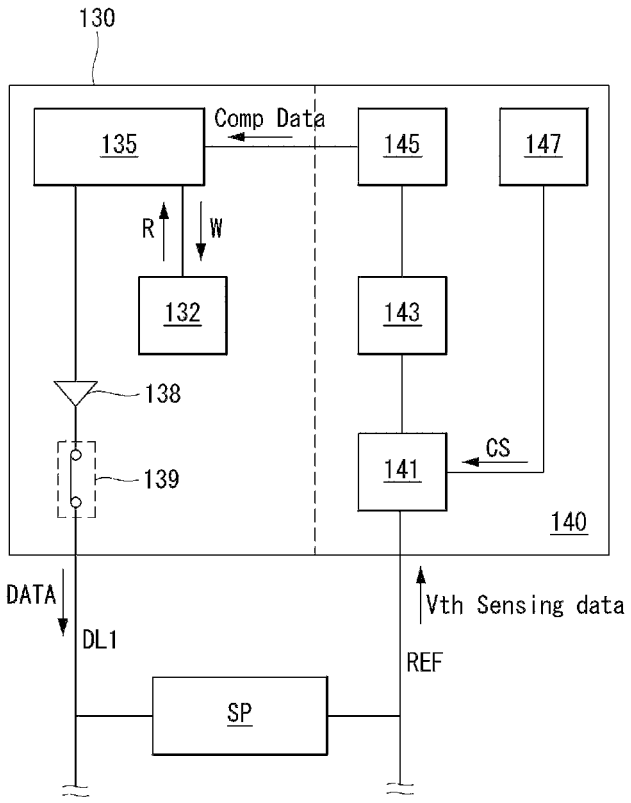
FIG. 5 is a view illustrating a detailed configuration of a part of the device according to a modification of the present invention.

FIG. 3 is a view illustrating a detailed configuration of a part of the device according to the exemplary embodiment of the present invention. FIG. 4 is a view illustrating the circuit configuration of the subpixel of FIG. 3. FIG. 5 is a view illustrating a detailed configuration of a part of the device according to a modification of the present invention.

As shown in FIGS. 3 and 4, the organic light emitting display according to the exemplary embodiment of the present invention comprises a data driver 130, a sensing circuit unit 140, and a subpixel SP. The subpixel SP comprises a storage capacitor, a switching transistor, a driving transistor, a sensor transistor ST, and an organic light emitting diode.

The functions of the elements included in the subpixel SP will be schematically described below.

The storage capacitor serves to store a data signal as a data voltage. The switching transistor serves as a switch to store the data voltage in the storage capacitor. The driving transistor serves to supply a driving current to the organic light emitting diode. The sensor transistor ST serves to connect to nodes Vx, Vz for sensing the characteristics of the driving transistor. The organic light emitting diode serves to emit light.

The above-mentioned subpixel SP is connected to two or more scan lines Scan and Sense and a data line DL1. When a first scan signal is supplied through the first scan line Scan, the subpixel SP operates to store a data signal output from the data driver 130 in the storage capacitor. When a second scan signal is supplied through the second scan line Sense, the subpixel SP operates to perform a sensing operation using the sensing circuit unit 140. A reference line REF is formed between a sensing node Vz of the sensor transistor ST included in the subpixel SP and the sensing circuit unit 140. The sensor transistor ST is connected to the source node Vx of the driving transistor included in the subpixel SP.

As shown in FIG. 4, the above-described subpixel SP may comprise a switching transistor SW, a driving transistor DT, a storage capacitor Cst, an organic light emitting diode OLED, and a sensor transistor ST. The transistors SW, DT, and ST included in the subpixel SP are formed as N type, and the relation of electric connections between theses transistors will be described below.

The switching transistor SW comprises a gate electrode connected to the first scan line Scan, a first electrode connected to the data line DL1, and a second electrode connected to the gate electrode of the driving transistor DT. The driving transistor DT comprises a gate electrode connected to the second electrode of the switching transistor SW, a drain electrode connected to a first potential voltage line EVDD, and a source electrode connected to the anode of the organic light emitting diode.

The storage capacitor Cst comprises one end connected to the gate electrode of the driving transistor DT and the other end connected to the source electrode of the driving transistor DT. The organic light emitting diode OLED comprises an anode connected to the source electrode of the driving transistor DT and a cathode connected to a second potential voltage line EVSS. The sensor transistor ST comprises a gate electrode connected to the second scan line Sense, a second electrode connected to the source electrode of the driving transistor DT, and a first electrode connected to the reference line REF.

The illustrated circuit configuration of the subpixel SP is only an example, and the present invention is not limited to it. For example, one or more of the transistors SW, DT, and ST included in the subpixel SP may be formed as P type, rather than N type. Also, the subpixel SP may further comprise transistors or capacitors that perform other functions, in addition to the illustrated transistors SW, DT, and ST.

The sensing circuit unit 140 may comprise a first circuit portion 141 for converting the voltage of the reference line REF into a pulse voltage, a second circuit portion 143 for outputting the pulse voltage resulting from the conversion by the first circuit portion 141 as a step voltage, a third circuit portion 145 for converting the step voltage output from the second circuit portion 143 to digital format, and a fourth circuit portion 147 for outputting a switching control signal CS during a vertical blank interval.

The above configuration, however, is merely an example, and the sensing circuit unit 140 may have a simple configuration in which the second and third circuit portions 143 and 145 are integrated together and the integrated circuit converts an analog voltage sensed through the reference line REF into a digital voltage and outputs the digital voltage. In this case, an initialization voltage fed through the reference line REF may be a negative voltage or a positive voltage, and may vary between the negative voltage and the positive voltage. The initialization voltage fed through the reference line REF may be chosen as positive so long as it is below the threshold voltage OLED Vth of the organic light emitting diode.

The first circuit portion 141 obtains a sensing value (Vth sensing data) by sensing the threshold voltage of the driving transistor DT of the subpixel SP through the reference line REF. In response to a switching control signal CS supplied from the fourth circuit portion 147, the first circuit portion 141 performs a switching operation to supply an initialization voltage supplied through an initialization voltage terminal VINIT to the reference line REF or convert the voltage of the reference line REF into a pulse voltage.

To this end, the first circuit portion 141 may be configured as a passive element, along with N switching circuits (N is 1 or greater) that electrically connect the output end of the initialization voltage terminal VINIT and the reference line REF or electrically connect the input end of the second circuit portion 143 and the reference line REF, in response to the switching control signal CS. If the first circuit portion 141 is a passive element, the stability and uniformity of voltages input and output through the input end of the second circuit portion 143 and the output end of the initialization voltage terminal VINIT can be improved. The first circuit portion 141 may consist of a resistor, a capacitor, etc.; however, if the first circuit portion 141 is a passive element, these elements may be omitted depending on the circuit configuration and performance.

The second circuit portion 143 is configured as a charge pump circuit that accumulates an input voltage and boosts an output voltage so that the pulse voltage resulting from the conversion using the switching operation of the first circuit portion 141 is output as a step voltage. The second circuit portion 143 has the above configuration to reduce noise (the resistance component and the capacitor component) generated on the reference line REF or the like at the time of sensing.

The third circuit portion 145 is configured as an analog-to-digital converter to convert an analog step voltage output from the second circuit portion 143 to digital format. The third circuit portion 145 serves to convert an analog step voltage into a digital step voltage, and prepares compensation data Comp Data for compensating a data signal based on the step voltage. The third circuit portion 145 may directly prepare compensation data Comp data for determining the level of compensation through various calculation processes, or may indirectly prepare only the difference relative to the previous value based on the step voltage.

The fourth circuit portion 147 outputs a switching control signal CS for controlling the switching operation (or sensing operation) of the first circuit portion 141. The fourth circuit portion 147 outputs a switching control signal CS at the start and end of the vertical blank interval which is the time between frames.

The fourth circuit portion 147 outputs a switching control signal CS for activating the switching operation of the first circuit portion 141 at the start of the vertical blank interval, and outputs a switching control signal CS for deactivating the switching operation of the first circuit portion 141 at the end of the vertical blank interval. When the switching operation of the first circuit portion 141 is activated, the sensing circuit unit 140 goes into sensing start mode, and when the switching operation of the first circuit portion 141 is deactivated, the sensing circuit unit 140 goes into sensing standby mode.

The characteristics (threshold voltage, current mobility, etc.) of the driving transistor of each subpixel SP of the above-described display panel change over time with the internal or external environment. The sensing circuit unit 140 serves to sense these characteristics and prepare compensation data Comp Data for compensating a data signal. The data driver 130 serves to compensate and output the data signal based on the compensation data Comp Data supplied from the sensing circuit unit 140.

The sensing circuit unit 140 may be included in the data driver 130. Based on this, a modification of the exemplary embodiment of the present invention will be described below.

As shown in FIG. 5, the sensing circuit unit 140 is included in the data driver 130. Accordingly, the data driver 130 comprises the sensing circuit unit 140, as well as a memory 132, a data signal compensator 135, a data signal converter 138, and a data signal output part 139.

The memory 132 is located inside or outside the data driver 130, and has at least one bank allocated to it. Compensation data is written to the memory 132. The compensation data written to the memory 132 is written or read by the data signal compensator 135.

The data signal compensator 135 serves to compensate a data signal DATA based on compensation data Comp Data supplied from the sensing circuit unit 140. The data signal compensator 135 reads (R) previous compensation data and writes (W) new compensation data through different banks of the memory 132.

To this end, the data signal compensator 135 occupies only the first bank of the memory 132, and reads (R) previous compensation data and writes (W) new compensation data through the first bank. In this case, however, a data collision or the like may occur during read and write operations (R) and (W) of compensation data. To solve this problem, the data signal compensator 135 may occupy the first and second banks of the memory 132, and read (R) previous compensation data and write (W) new compensation data through these banks. However, this is merely an illustration, and the allocation of banks of the memory 132 and the operation of the data signal compensator 135 may vary depending on the sensing method (line sensing, block sensing, frame sensing, etc.).

The data signal converter 138 serves to convert a digital data signal into an analog data signal. The data signal converter 138 converts a data signal compensated by the data signal compensator 135 or a non-compensated data signal in response to a gamma reference voltage. The data signal output part 139 serves to output a data signal DATA.

With the above-described configuration, when the characteristics of the driving transistor DT of each subpixel SP of the display panel are sensed, compensation data Comp Data for compensating the data signal is prepared based on these characteristics. However, this is merely an illustration, and the sensing circuit unit 140 and the data driver 130 are not limited to this configuration and may be modified in various ways.

A compensation method using the above-described sensing circuit unit 140 is implemented in a way that enables real time compensation, because sensing data and compensation data Comp Data are prepared during the vertical blank interval (or sensing and compensation data generation interval) and the compensation data is output during an image display interval (or data signal write interval). The sensing and compensation data generation interval and the data signal write interval may be within the same frame. Alternatively, the sensing and compensation data generation interval and the data signal write interval may have a time gap of multiple frames. That is, the sensing data and compensation data for a set of subpixels may be prepared during a vertical blank interval, and the compensated display data corresponding to the set of subpixels may be output during an image display interval occurring multiple frames after the vertical blank interval of the sensing operation.

However, the results of implementation and testing of the above-described organic light emitting display show that the following problem may occur. Thus, a solution to this problem was devised.

Figure 6:
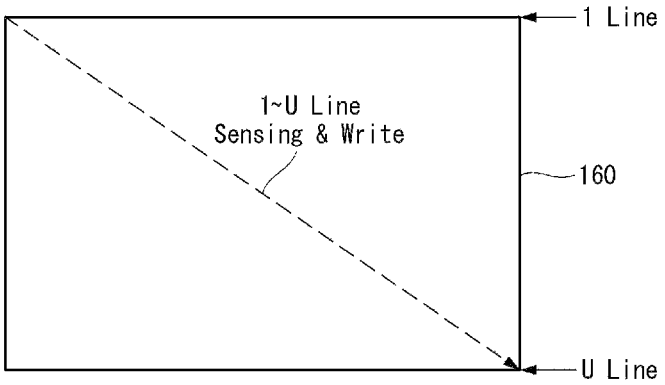
FIG. 6 is a view showing an example of a sensing method used in a test example.
Figure 7:
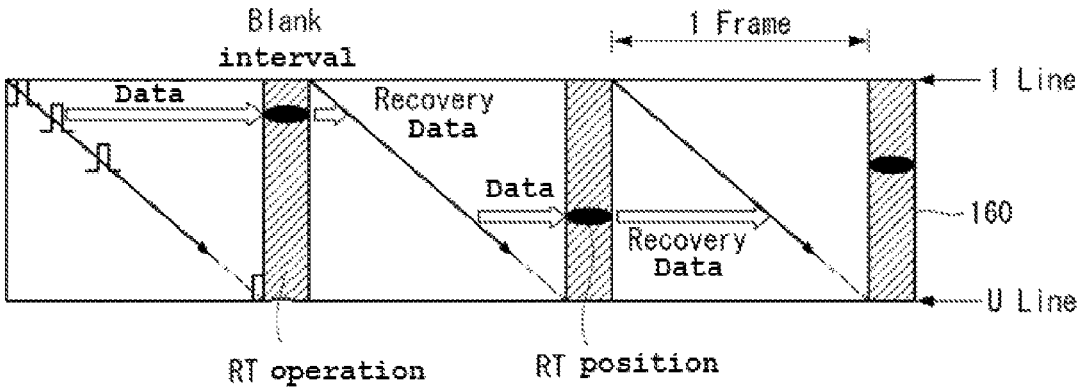
FIG. 7 is a view showing the test example of FIG. 6 in detail.
Figure 8:
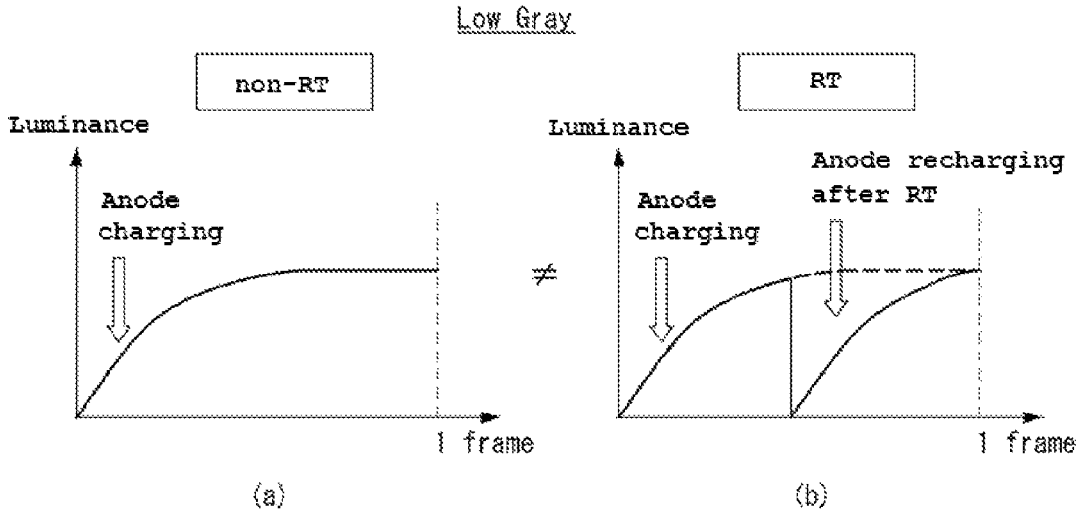
FIG. 8 is a graph showing the charging of an anode to explain a problem caused by the sensing method of the test example.
Figure 9:
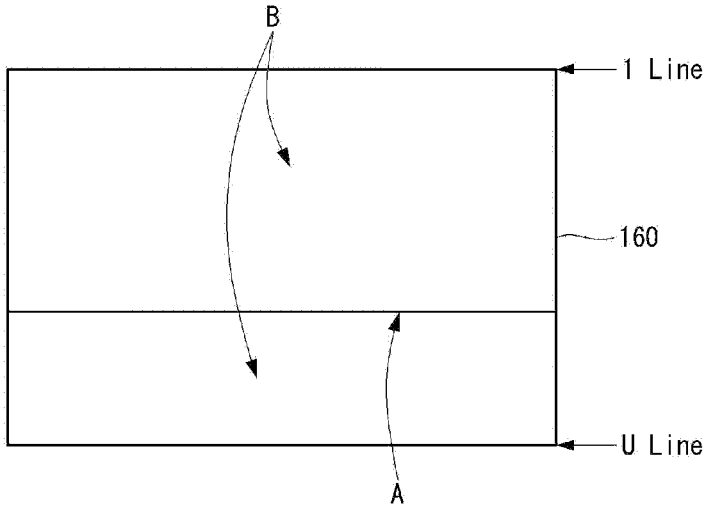
FIG. 9 is a view illustrating a phenomenon observed on the display panel due to the charging problem of FIG. 8.
Figure 10:
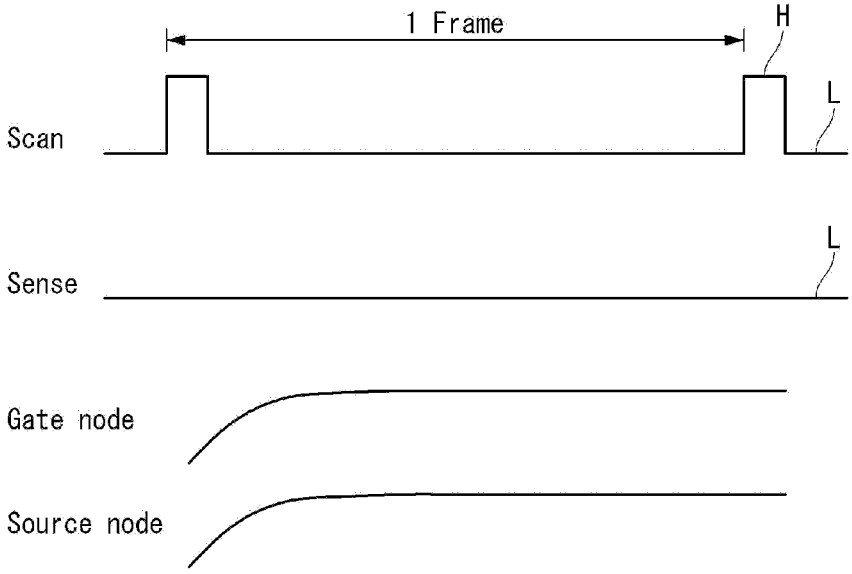
FIG. 10 is a view showing driving waveforms and node voltages according to the test example.
Figure 11:
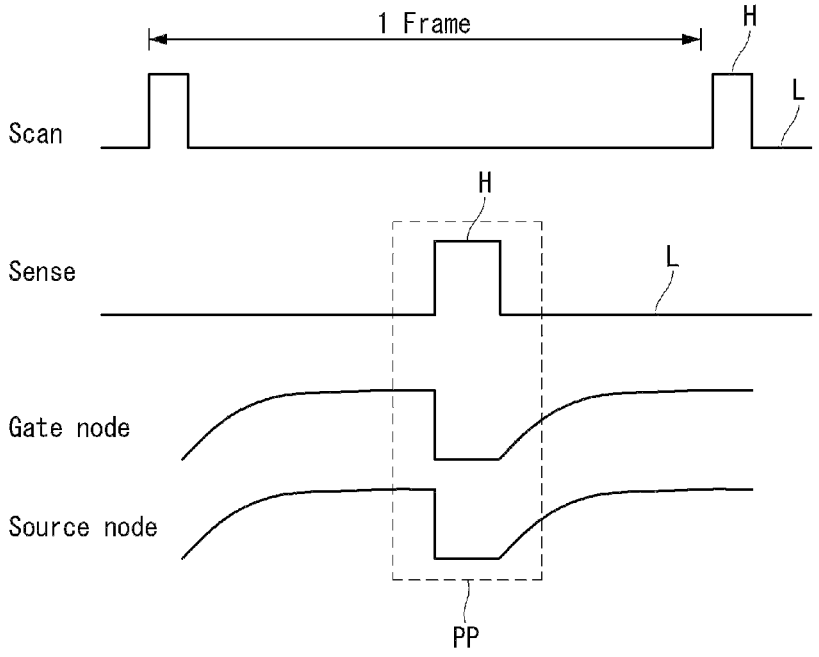
FIG. 11 is a view showing driving waveforms and node voltages according to the exemplary embodiment.
Figure 12:
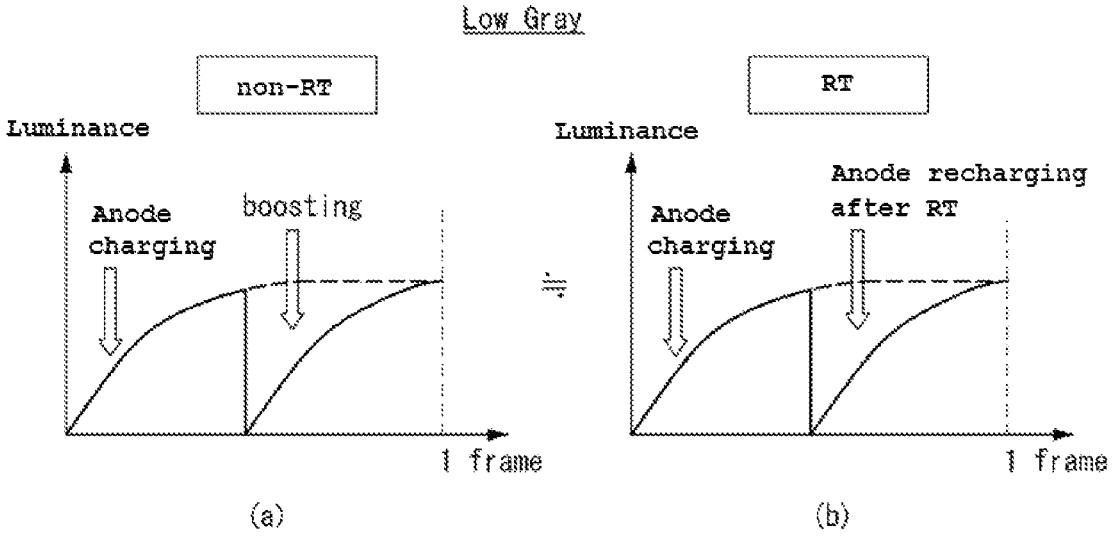
FIG. 12 is a graph showing the charging of an anode to explain an improvement achieved by the sensing method of the exemplary embodiment.
Figure 13:
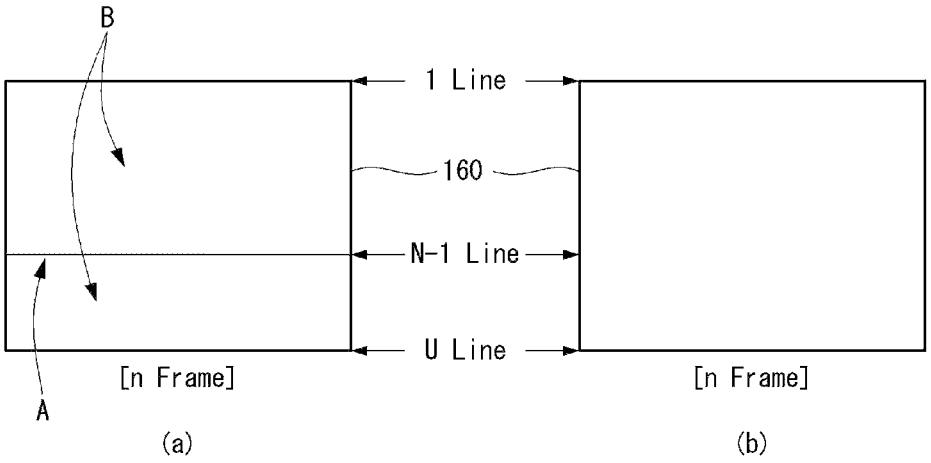
FIG. 13 is a view illustrating a phenomenon observed on the display panel to compare the test example and the exemplary embodiment.
Figure 14:
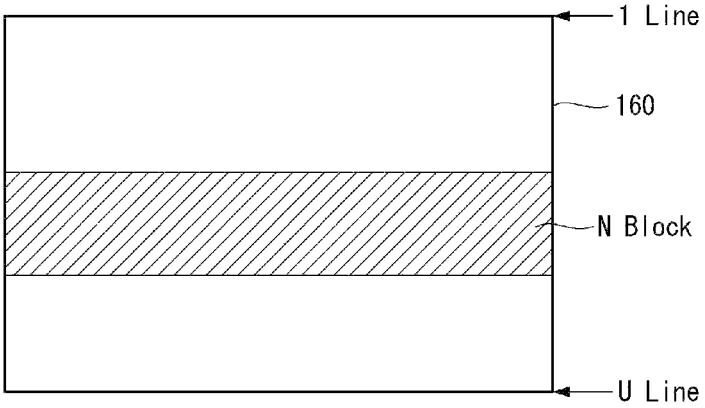
FIG. 14 is a view for explaining another sensing method to which the exemplary embodiment is applicable.
Figure 15:
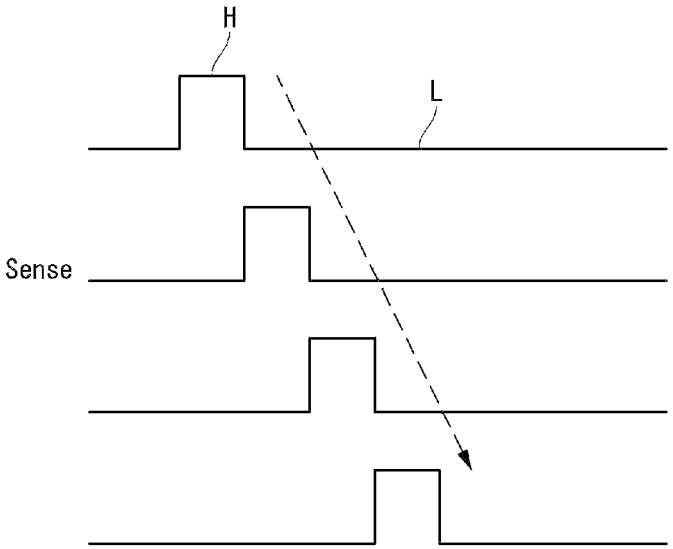
FIGS. 15 and 16 are views illustrating waveforms of a second scan signal according to the exemplary embodiment.
Figure 16:
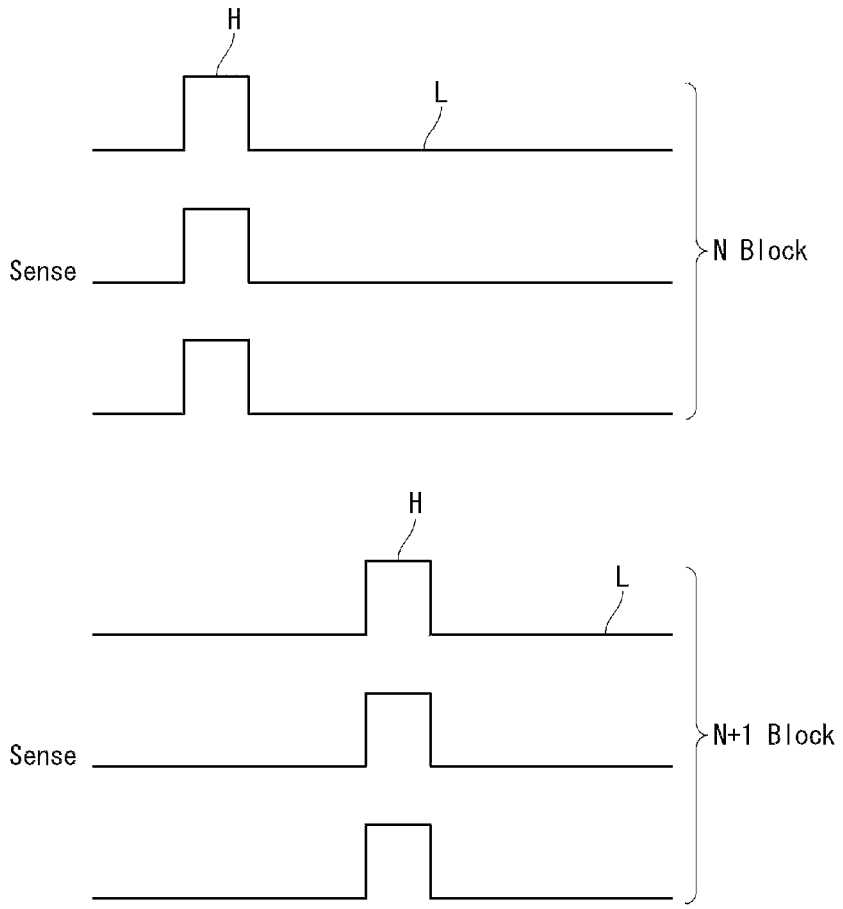
Figure 17:
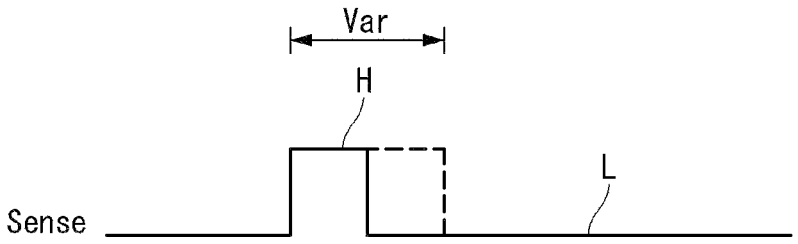
FIG. 17 is a view illustrating a variation of the second scan signal according to the exemplary embodiment.

FIG. 6 is a view showing an example of a sensing method used in a test example. FIG. 7 is a view showing the test example of FIG. 6 in detail. FIG. 8 is a graph showing the charging of an anode to explain a problem caused by the sensing method of the test example. FIG. 9 is a view illustrating a phenomenon observed on the display panel due to the charging problem of FIG. 8. FIG. 10 is a view showing driving waveforms and node voltages according to the test example. FIG. 11 is a view showing driving waveforms and node voltages according to the exemplary embodiment. FIG. 12 is a graph showing the charging of an anode to explain an improvement achieved by the sensing method of the exemplary embodiment. FIG. 13 is a view illustrating a phenomenon observed on the display panel to compare the test example and the exemplary embodiment. FIG. 14 is a view for explaining another sensing method to which the exemplary embodiment is applicable. FIGS. 15 and 16 are views illustrating waveforms of a second scan signal according to the exemplary embodiment. FIG. 17 is a view illustrating a variation of the second scan signal according to the exemplary embodiment.

As shown in FIG. 6, the sensing circuit unit senses 1 to U lines corresponding to the first to last rows of the display panel 160 and prepares compensation data, during the vertical blank interval but not during the image display interval in which an image is displayed through the display panel 160.

As shown in FIG. 7, in the test example, the position of a target (RT position) to be sensed for real-time compensation is randomly (or sequentially) chosen. This can be found out from the position of the target (RT position) to be sensed that differs with each frame.

The test example has an advantage in terms of real-time compensation over frame sensing since the position of a target (RT position) to be sensed is randomly (or sequentially) chosen (line sensing and block sensing). This is because an increase in the number of targets to be sensed for real-time compensation causes difficulties in real-time compensation (including problems associated with saving sensing data, the time required for compensation data calculation, etc.). Nevertheless, the compensation operation of the test example, too, will eventually prepare sensing and compensation data across every line.

However, the result of the test shows that random choosing of the position of a target (RT position) to be sensed for real-time compensation brings about the following problem.

As shown in (a) of FIG. 8, a subpixel to which real-time compensation is not applied (which is referred to as a non-RT subpixel) receives a non-compensated data signal, and therefore the node of the anode of the organic light emitting diode shows a constant charging curve.

On the contrary, as shown in (b) of FIG. 8, a subpixel to which real-time compensation is applied (which is referred to as an RT subpixel) receives a compensated data signal, and therefore the node of the anode of the organic light emitting diode shows an inconstant charging curve. This can be easily understood from (b) of FIG. 8 illustrating that the node of the anode of the organic light emitting diode is charged twice from the time of "RT position" (for example, (1) anode charging time and (2) after RT).

As can be seen from the charging curves of FIG. 8, unlike the non-RT subpixel, the RT subpixel receives a non-compensated data signal until a certain point in time and then receives a compensated data signal. As a consequence, a charging deviation occurs between the non-RT subpixel and the RT subpixel. Also, the charging deviation between the non-RT subpixel and the RT subpixel is seen more clearly at low gray level.

As shown in FIG. 9, it is observed that the charging deviation between the non-RT subpixel B and the RT subpixel A induces a luminance deviation (see A corresponding to the RT subpixel and B corresponding to the non-RT subpixel) across the entire display panel 160. Due to this, the RT subpixel on the display panel 160 is perceived with the naked eye.

The biggest reason for the above-mentioned problem in the test example is because there is a voltage difference between the source nodes Vx of the driving transistors of the non-RT subpixel B and the RT subpixel A.

FIG. 10 is a view showing driving waveforms and node voltages according to the test example. FIG. 11 is a view showing driving waveforms and node voltages according to the exemplary embodiment. FIG. 12 is a graph showing the charging of an anode to explain an improvement achieved by the sensing method of the exemplary embodiment. FIG. 13 is a view illustrating a phenomenon observed on the display panel to compare the test example and the exemplary embodiment. FIG. 14 is a view for explaining another sensing method to which the exemplary embodiment is applicable.

Hereinafter, the test example and the exemplary embodiment for solving the problems occurring in the test example will be described in detail by referring to FIGS. 10 to 14 to help understanding of the description.

Test Example

In the test example, the position of a target (RT position) to be sensed for real-time compensation was randomly (or sequentially) chosen. Also, as shown in FIG. 10, a first scan signal supplied through the first scan line Scan to the non-RT subpixel was kept at logic high H once for 1 frame. A second scan signal supplied through the second scan line Sense to the non-RT subpixel was kept at logic low L during an image display interval (or data signal write interval).

As a consequence, the gate node Va and source node Vx of the driving transistor DT of the non-RT subpixel were charged in such a way that their voltages increase non-linearly toward saturation as shown in FIG. 10.

Exemplary Embodiment

In the exemplary embodiment, the position of a target (RT position) to be sensed for real-time compensation was randomly (or sequentially) chosen. Also, as shown in FIG. 11, a first scan signal supplied through the first scan line Scan to the non-RT subpixel was kept at logic high H once for 1 frame. On the other hand, as shown in FIG. 11, a second scan signal supplied through the second scan line Sense to the non-RT subpixel was kept at logic high H once for 1 frame.

As a consequence, the gate node Va and source node Vx of the driving transistor DT of the non-RT subpixel were charged in such a way that their voltages increase non-linearly toward saturation and then increase non-linearly again toward saturation, as shown in FIG. 11.

By turning on the sensor transistor ST of the non-RT subpixel, the source node Vx of the driving transistor DT of the non-RT subpixel is discharged for a predetermined time during the image display interval. This allows the voltage pattern at the node Vx of the non-RT subpixel to mimic the voltage pattern at the node Vx of a RT subpixel that received compensation data during an image display interval. However, turning on the sensor transistors of the non-RT subpixels is one example of discharging the node Vx of non-RT subpixels, and the present invention is not limited to this. For example, the display panel may further comprise other elements such as capacitors etc. that perform discharging of the node Vx of the non-RT subpixels, in addition to or in place of the illustrated sensor transistors ST.

A comparison between the test example and the exemplary embodiment will be made below.

In the test example, the sensor transistor ST of the non-RT subpixel is not driven because data compensation is applied only to the RT subpixel. That is, as shown in FIG. 10, the second scan signal supplied to the non-RT subpixel is applied as a signal (e.g., logic low L) for turning off the sensor transistor ST. In this case, only the second scan signal supplied to the RT subpixel is applied as a signal for turning on the sensor transistor ST.

In the exemplary embodiment, on the other hand, the sensor transistor ST of the non-RT subpixel is driven even though data compensation is applied only to the RT subpixel. That is, as shown in FIG. 11, the second scan signal supplied to the non-RT subpixel is applied as a signal (e.g., logic high H) for temporarily turning on the sensor transistor ST.

In the exemplary embodiment, the second scan signal is likewise applied as a signal for turning on the sensor transistor ST of the non-RT subpixel during an image display interval (or data signal write interval) such as "PP" so the node Vx between the organic light emitting diode and the driving transistor of the non-RT subpixel is discharged for a predetermined time during the image display interval.

Meanwhile, a data signal, as well as a compensated data signal for RT subpixels, is applied to every subpixel in response to a sequentially-supplied first scan signal. Therefore, in the exemplary embodiment, a second scan signal is produced and supplied to sequentially turn on the sensor transistor ST of every non-RT subpixel during the image display interval (or data signal write interval).

According to the test example, the second scan signal changes to and stays at logic high for a predetermined time to turn on only the sensor transistor ST of the RT subpixel during the vertical blank interval. On the contrary, according to the exemplary embodiment, the second scan signal changes to and stays at logic high for a predetermined time to turn on only the sensor transistor ST of the RT subpixel during the vertical blank interval (1: sensing operation), and also changes to and stays at logic high for a predetermined time to turn on the non-RT subpixel during the image display interval (2: compensation operation).

That is, in the exemplary embodiment, the non-RT subpixels are re-boosted by sequentially turning on their sensor transistors ST, in order to solve the problem occurring in the test example (the charging deviation between the RT subpixel and the non-RT subpixel). In this case, the re-boosted non-RT subpixels, like the RT subpixels, may have a tendency to be instantaneously discharged (or turned off) and then recharged, because the re-boosted non-RT subpixels receive voltages below the threshold voltage of the organic light emitting diodes. Therefore, the expression "re-boost" is used because the organic light emitting diodes of the non-RT subpixels have a tendency to be instantaneously discharged (or turned off) and then recharged, but it may be construed otherwise.

As a consequence, as shown in (a) and (b) of FIG. 12, the nodes Vx of the anodes of the organic light emitting diodes of both the subpixel to which real-time compensation is not applied (which is referred to as the non-RT subpixel) and the subpixel to which real-time compensation is applied (which is referred to as the RT subpixel) show a similar or the same charging curve. That is, the charging curves of the nodes Vx of the non-RT subpixels mimic the charging curves of the nodes Vx of the compensated RT subpixels. Also, the charging deviation between the non-RT subpixel and the RT subpixel is better improved at low gray than at high gray and middle gray.

However, the charging patterns in FIG. 12 show "anode charging", "boosting", and "anode recharging" happening at approximately simultaneous times for non-RT and RT subpixels. Since the scan and sense lines for non-RT and RT subpixels may turned on at different times within one frame (due to time delay and etc.). Thus, non-RT and RT subpixels have a time gap between two curves in FIG. 12.

As shown in (a) of FIG. 13, in the test example, only the sensor transistor ST of the RT subpixel is turned on during the vertical blank interval, and therefore the charging deviation between the non-RT subpixel B and the RT subpixel A induces a luminance deviation (see A corresponding to the RT subpixel and B corresponding to the non-RT subpixel) across the entire display panel 160.

On the contrary, as shown in (b) of FIG. 13, in the exemplary embodiment, the sensor transistor ST of the non-RT subpixel is turned on during the image display interval, and therefore the charging deviation between the non-RT subpixel B and the RT subpixel A is eliminated, thus inducing no luminance deviation (see A corresponding to the RT subpixel and B corresponding to the non-RT subpixel) across the entire display panel 160.

The foregoing exemplary embodiment has been described with an example where the position of a target (RT position) to be sensed for real-time compensation is randomly chosen. However, the present invention also applies to when the position of a target (RT position) to be sensed for real-time compensation is sequentially chosen.

As shown in FIG. 14, the present invention also applies to when the position of a target (RT position) to be sensed for real-time compensation is chosen on a block-by-block basis for N blocks, each block comprising a plurality of rows of the display panel.

As shown in FIG. 15, the second scan signal may sequentially change to logic high so as to sequentially turn on the sensor transistors. In this case, a reduction in the cost of circuit configuration is expected because there is no need to vary the duty cycle of a clock signal supplied to the shift register, etc. and alter the circuit configuration on a large scale.

Moreover, as shown in FIG. 16, the second scan signal may change to logic high simultaneously in one block so that every sensor transistor within the same block is simultaneously turned on, and the transition to logic high may occur sequentially on a block-by-block basis. In this case, an improvement in scan time is expected although it might require a variation of the duty cycle of a clock signal supplied to the shift register, etc. or a partial alteration of the circuit configuration.

Similarly, the sensor transistors of the non-RT subpixels may be turned on sequentially during the image display interval. The non-RT subpixels may be arranged into N blocks and the second scan signal may change to logic high simultaneously in one block so that every sensor transistor within the same block is simultaneously turned on, and the transition to logic high may occur sequentially on a block-by-block basis. However, this is merely an illustration, and other configurations may be used to turn on the sensor transistors.

The charging deviation between the non-RT subpixel B and the RT subpixel A may vary depending on the characteristics of the display panel, the response speed of the device, etc. To overcome this, the turn-on time of the sensor transistor ST of the non-RT subpixel may need to be varied.

Therefore, in the exemplary embodiment, the pulse width of the second scan signal may be varied (Var) as shown in FIG. 17, in order to vary (or adjust) the turn-on time of the sensor transistor ST of the non-RT subpixel. In this case, the pulse width of the second scan signal corresponds to the characteristics of the display panel, the response speed of the device, etc., and may be therefore equal for every line or differ for at least one line or line by line. In this way, the circuit may be configured based on the characteristics of the display panel, the response speed of the device, etc. by varying the turn-on time of the sensor transistor ST of the non-RT subpixel.

As seen from above, the present invention offers the advantage of solving the problem of reduced lifetime of the device caused by a decrease in operating current due to changes over time in the characteristics (threshold voltage, current mobility, etc.) of the driving transistor of each subpixel. Moreover, the present invention offers the advantage of preventing and improving a luminance deviation caused by real-time compensation by controlling a subpixel selected for compensation and subpixels not selected for compensation such that the nodes of the anodes of the organic light emitting diodes of both the selected subpixel and the non-selected subpixels show a similar or the same charging status.

What is claimed is:

1. An organic light emitting display comprising:

a display panel including subpixels;

a data driver that supplies a plurality of data signals to the display panel;

a scan driver that supplies a plurality of scan signals to the display panel; and a sensing circuit unit that measures threshold voltages of driving transistors through sensor transistors of the display panel and prepares compensation data, wherein the scan driver turns on the sensor transistors of selected subpixels to measure the threshold voltages of the driving transistors of the selected subpixels during a vertical blank interval of the display panel, and turns on the sensor transistors of non-selected subpixels to supply voltages below a threshold voltage of organic light emitting diodes to the non-selected subpixels during an image display interval of the display panel.

2. The organic light emitting display of claim 1, wherein a charging status at nodes of anodes of the organic light emitting diodes of the non-selected subpixels mimic a charging status at nodes of anodes of the organic light emitting diodes of the selected subpixels during the image display interval of the display panel.

3. The organic light emitting display of claim 1, wherein nodes of anodes of organic light emitting diodes of the selected subpixels and the non-selected subpixels are charged during the image display interval of the display panel in such a way that voltages at the nodes of the anodes of the organic light emitting diodes of the selected subpixels and the non-selected subpixels increase non-linearly toward saturation and then increase non-linearly again toward saturation.

4. The organic light emitting display of claim 1, wherein the scan driver sequentially turns on the sensor transistors of the non-selected subpixels during the image display interval of the display panel.

5. The organic light emitting display of claim 1, wherein, during the image display interval of the display panel, the non-selected subpixels are arranged into N blocks (N is an integer equal to or greater than 2) and the scan driver turns on the sensor transistors of the non-selected subpixels on a block-by-block basis.

6. The organic light emitting display of claim 1, wherein the scan driver varies a pulse width of a scan signal to adjust turn-on time of the sensor transistors of the non-selected subpixels during the image display interval of the display panel.

7. The organic light emitting display of claim 1, wherein the sensing circuit unit senses the threshold voltages of the driving transistors of a line of subpixels on the display panel during the vertical blank interval of the display panel.

8. The organic light emitting display of claim 1, wherein, during the vertical blank interval of the display panel, the subpixels are arranged into N blocks (N is an integer equal to or greater than 2) of the display panel and the sensing circuit unit senses the threshold voltages of the driving transistors of the blocks of subpixels.

9. The organic light emitting display of claim 1, wherein the sensing circuit unit comprises:

a first circuit for converting a voltage of a reference line connected to the subpixels into a pulse voltage;

a second circuit for outputting the pulse voltage resulting from the conversion by the first circuit as a step voltage;

a third circuit for converting the step voltage output from the second circuit to digital format; and a fourth circuit for outputting a switching control signal to control switching circuits of the first circuit during the vertical blank interval of the display panel.

10. The organic light emitting display of claim 1, wherein a voltage pattern at a node between the organic light emitting diode and the driving transistor of each of the non-selected subpixels mimics a voltage pattern at a node between the organic light emitting diode and the driving transistor of each of the selected subpixels.

11. The organic light emitting display of claim 1, wherein the scan driver turns on the sensor transistors of the non-selected subpixels while the selected subpixels are displaying an image during the image display interval of the display panel.

12. A method of driving an organic light emitting display, the method comprising:

turning on sensor transistors of selected subpixels to measure threshold voltages of driving transistors of the selected subpixels during a vertical blank interval of a display panel;

turning on sensor transistors of non-selected subpixels to supply voltages below a threshold voltage of organic light emitting diodes to the non-selected subpixels during an image display interval of the display panel; and preparing compensation data based on the threshold voltages of the driving transistors and outputting the compensation data.

13. The method of claim 12, wherein a charging status at nodes of anodes of the organic light emitting diodes of the non-selected subpixels mimic a charging status at nodes of anodes of the organic light emitting diodes of the selected subpixels during the image display interval of the display panel.

14. The method of claim 12, wherein nodes of anodes of organic light emitting diodes of the selected subpixels and the non-selected subpixels are charged during the image display interval of the display panel in such a way that voltages at the nodes of the anodes of the organic light emitting diodes of the selected subpixels and the non-selected subpixels increase non-linearly toward saturation and then increase non-linearly again toward saturation.

15. The method of claim 12, wherein the sensor transistors of the non-selected subpixels are sequentially turned on during the image display interval of the display panel.

16. The method of claim 12, wherein, during the image display interval of the display panel, the non-selected subpixels are divided into N blocks (N is an integer equal to or greater than 2) and turned on block-by-block.

17. The method of claim 12, wherein a turn-on time of the sensor transistors of the non-selected subpixels is varied during the image display interval of the display panel.

18. The method of claim 12, wherein the threshold voltages of the driving transistors of a line of subpixels on the display panel are sensed during the vertical blank interval of the display panel.

19. The method of claim 12, wherein, during the vertical blank interval of the display panel, the subpixels of the display panel are divided into N blocks (N is an integer equal to or greater than 2) and the threshold voltages of the driving transistors of the blocks of subpixels are sensed.

20. The method of claim 12, wherein the sensor transistors of the non-selected subpixels are turned on while the selected subpixels are displaying an image during the image display interval of the display panel.

* * * * *